US009380820B1

(12) United States Patent
Griego

(10) Patent No.: US 9,380,820 B1
(45) Date of Patent: Jul. 5, 2016

(54) CLENCH ARRESTING GLOVE

(71) Applicant: Linda M. Griego, LaPorte, CO (US)

(72) Inventor: Linda M. Griego, LaPorte, CO (US)

( * ) Notice: Subject to any disclaimer, the term of this patent is extended or adjusted under 35 U.S.C. 154(b) by 2 days.

(21) Appl. No.: 14/601,481

(22) Filed: Jan. 21, 2015

(51) Int. Cl.

| | |
|---|---|
| ***A63B 21/02*** | (2006.01) |
| ***A63B 71/14*** | (2006.01) |
| ***A41D 19/00*** | (2006.01) |
| ***A41D 19/015*** | (2006.01) |

(52) U.S. Cl.
CPC ..... *A41D 19/01582* (2013.01); *A41D 19/00* (2013.01); *A63B 21/02* (2013.01); *A63B 21/4025* (2015.10)

(58) Field of Classification Search
CPC ..... A63B 23/16; A63B 21/4025; A63B 21/4019; A63B 21/0442; A63B 21/0552; A63B 71/141; A63B 21/023; A63B 21/0407; A63B 23/14; A63B 21/0421; A63B 21/055; A63B 71/143; A63B 71/145; A41D 19/01582
See application file for complete search history.

(56) References Cited

U.S. PATENT DOCUMENTS 272,951 A * 2/1883 Gardner ..... A63B 23/16 482/48
494,197 A * 3/1893 Hall ..... A63B 23/16 482/48
818,332 A * 4/1906 Anson ..... A63B 23/16 482/48
867,981 A * 10/1907 Krizek ..... A63B 23/16 482/48
1,220,476 A * 3/1917 Ujdur ..... A61F 5/05875 602/22
1,708,757 A * 4/1929 Freileweh ..... A61F 5/05866 602/20
2,025,357 A * 12/1935 Pagan ..... A41D 19/01505 2/16
2,783,759 A * 3/1957 Hill ..... A61F 5/50 128/879
3,347,547 A * 10/1967 Hynes ..... A63B 23/16 482/47
3,944,220 A * 3/1976 Fasano ..... A63B 21/0552 2/159
4,173,218 A * 11/1979 Cronin ..... A61F 13/104 128/DIG. 20
4,384,571 A * 5/1983 Nuzzo ..... A61F 5/05875 602/22
4,675,914 A * 6/1987 Mitchell ..... A41D 19/01588 2/159
4,706,658 A * 11/1987 Cronin ..... A41D 19/01588 128/DIG. 20
4,765,320 A * 8/1988 Lindemann ..... A61F 5/0118 602/22
4,781,178 A * 11/1988 Gordon ..... A61F 5/0118 602/22
4,796,306 A * 1/1989 Mitchell ..... A63B 71/148 2/161.5

(Continued)

*Primary Examiner* — Bobby Muromoto, Jr.
(74) *Attorney, Agent, or Firm* — PatentFile, LLC; Bradley C. Fach; Steven R. Kick

(57) ABSTRACT

A glove to prevent involuntary clenching of the hand may comprise a five phalange regions extending outwardly from a dorsal and palm region which are configured to receive portions of the hand of a user. A pull strap anchor may be positioned on the dorsal region. The glove may further comprise five pull straps. Each pull strap may be configured to receive a finger or a user's hand, and may comprise a first end which may be coupled to a phalange region and a second end which may be removably coupled to the pull strap anchor. By coupling the pull straps to the pull strap anchor, a reverse counterforce may be exerted against the phalange regions as to open the hand and prevent involuntary clenching.

21 Claims, 7 Drawing Sheets

(56) References Cited

U.S. PATENT DOCUMENTS 4,830,360 A * 5/1989 Carr, Jr. ..... A63B 23/16 482/47
5,022,094 A * 6/1991 Hames ..... A41D 19/01547 2/159
5,027,802 A * 7/1991 Donohue ..... A61H 1/0218 602/22
5,113,526 A * 5/1992 Wang ..... A43B 7/32 2/10
5,156,168 A * 10/1992 Canterna ..... A61F 5/3761 128/879
5,295,948 A * 3/1994 Gray ..... A61F 5/05866 128/882
5,367,712 A * 11/1994 Smith ..... A63B 71/143 2/161.1
5,373,585 A 12/1994 Wiggins
5,435,013 A * 7/1995 Davis ..... A63B 71/146 2/161.1
5,453,064 A * 9/1995 Williams, Jr. ..... A63B 21/4025 2/161.1
5,527,244 A 6/1996 Waller et al.
5,538,488 A * 7/1996 Villepigue ..... A63B 21/004 482/44
5,628,069 A * 5/1997 Ebert ..... A41D 19/00 2/160
5,697,103 A * 12/1997 Wiggins ..... A41D 19/00 2/159
6,029,277 A 2/2000 Picchione, II
6,553,576 B1 * 4/2003 Knapp ..... A41D 19/01547 2/160
7,210,172 B2 * 5/2007 Adams, Jr. ..... A63B 21/045 2/160
7,234,172 B1 * 6/2007 Hoelscher ..... A41D 19/01582 2/161.1
7,406,720 B2 * 8/2008 Hoelscher ..... A41D 19/01588 2/161.1
7,475,433 B2 * 1/2009 Coulter ..... A41D 19/01582 2/160
7,601,130 B2 * 10/2009 Farrell ..... A63B 23/16 602/20
7,712,153 B2 * 5/2010 Adams, Jr. ..... A63B 21/045 2/163
7,731,633 B1 * 6/2010 Williams ..... A63B 21/0552 482/148
7,856,670 B1 * 12/2010 Hazuga ..... A63B 21/065 2/160
7,892,194 B2 * 2/2011 Farrell ..... A61F 5/0118 482/47
8,181,276 B2 * 5/2012 Homer ..... A41D 13/065 2/161.6
8,328,744 B2 * 12/2012 Farrell ..... A61F 5/0118 482/27
8,348,810 B2 * 1/2013 Land ..... A63B 21/00065 482/47
8,601,614 B2 * 12/2013 Scaff ..... A41D 19/00 2/160
8,652,076 B2 2/2014 Land et al.
2002/0029401 A1 3/2002 McEvoy
2010/0186143 A1 * 7/2010 Khoo ..... A41D 19/001 2/164
2011/0262707 A1 10/2011 Wilbert et al.
2012/0284900 A1 * 11/2012 Zichelle ..... A41D 19/0024 2/160

* cited by examiner

CLENCH ARRESTING GLOVE

FIELD OF THE INVENTION

The present patent specification relates to the field of therapeutic devices for the hands. More specifically, this patent specification relates to gloves for arresting involuntary clenching of the hands to straighten the fingers and improve hand function.

BACKGROUND

Often, as a result of aging, injury, or degenerative diseases such as arthritis, the hands of an individual may involuntarily clench as the fingers contract towards the palm. This involuntary clenching may also be due to inflammation, overuse or repetitive hand motions, swollen joints, damaged tissue or cartilage and other strain induced activities that weaken the muscles and ligaments in the hand. This clenching often occurs more at night while the individual is sleeping and is unable to prevent the clenching. Over time, repeated involuntary hand clenching may result in a reduced range of motion and weakness in the fingers and joints causing the hands to develop a claw like appearance.

Unfortunately, this debilitating and painful condition of involuntary hand clenching usually causes the individual exhibiting such behavior a great deal of distress or embarrassment. These individuals may find it difficult to unclench the hand upon waking This involuntary nocturnal clenching may even interfere with the ability of the individual to enter or maintain sleep. Furthermore, involuntary hand clenching may lead to additional hand and wrist weakness, the inability to hold on to objects, and even the lack of ability to pick up smaller objects. This involuntary clenching of the hands contributes significantly to the number of individuals who eventually become disabled due to the inability to use or work with their hands. According to the Center for Disease Control, more than 27 million Americans—more than 10% of the U.S. population—have been diagnosed with some form of arthritis and is the most common cause of disability among adults.

Currently, treatment for pain and swelling in the hands is limited to the use of compression gloves or varying types of finger splints. These gloves are made of an elastic material that compresses the hand of a user in an effort to limit the swelling that occurs from inflammation and to promote better blood circulation. Since these compression gloves provide a uniform compression over the surface of the hands and fingers, they are not capable of adequately decreasing the degree to which the hand is able to clench. As a result, these compression gloves are only able to slow the progression of the involuntary clench to a nominal degree, if at all.

Therefore, a need exists for novel therapeutic devices that are able to arrest involuntary clenching of the hands. There is a further need for a novel therapeutic device that can be worn on the hands for long periods of time, such as through the sleep cycle. A further need exists for novel therapeutic devices that are able to train the hand and reverse the effects of involuntary hand clenching. Finally, there exists a need for novel therapeutic devices that are adjustable and able to provide a varying degree of resistance to each individual finger to prevent or reverse the effects of involuntary clenching of the hands.

BRIEF SUMMARY OF THE INVENTION

A glove configured to be worn on the hand of a user to prevent involuntary clenching of the hand is disclosed herein.

In some embodiments, the glove may comprise: a dorsal region adapted to cover the back of a person's hand, with the dorsal region comprising a pull strap anchor positioned on the exterior surface of the glove; a thumb phalange region which may be coupled to a first end of a first pull strap and which may extend outwardly from the dorsal region; an index phalange region which may be coupled to a first end of a second pull strap and which may extend outwardly from the dorsal region; a middle phalange region which may be coupled to a first end of a third pull strap and which may extend outwardly from the dorsal region; a ring phalange region which may be coupled to a first end of a fourth pull strap and which may extend outwardly from the dorsal region; and a little phalange region which may be coupled to a first end of a fifth pull strap and which may extend outwardly from the dorsal region. The first, second, third, fourth, and fifth pull straps may each further comprise a second end removably coupled to the pull strap anchor thereby exerting a reverse counterforce against the phalange regions as to open the hand and prevent involuntary clenching.

In further embodiments, the dorsal region, thumb phalange region, index phalange region, middle phalange region, ring phalange region, and little phalange region may be constructed from a compressionable material.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

New medical devices that are able to arrest involuntary clenching of the hands are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
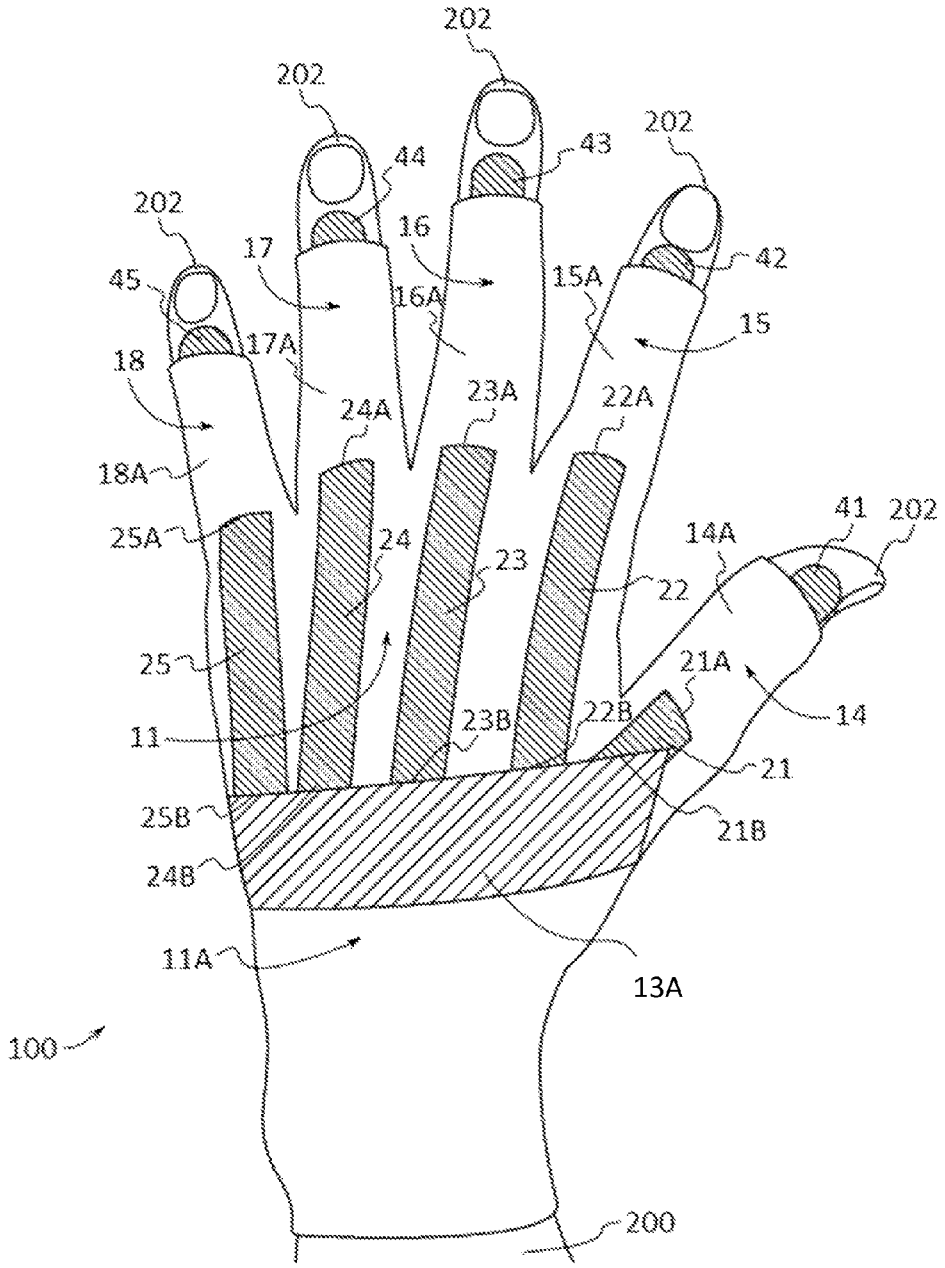
FIG. 1 depicts a posterior perspective view of an example of a clench arresting glove secured to the hand of a user according to various embodiments described herein.

The present invention will now be described by example and through referencing the appended figures representing preferred and alternative embodiments. FIG. 1 illustrates an example of a clench arresting glove ("the glove") 100 according to various embodiments. The glove 100 may be configured to cover portions of the anterior or palmar region and portions of the posterior or dorsum of the hand such as the metacarpus and/or one or more fingers and optionally anterior and posterior portions of the wrist of a user's hand 200. In this example, the glove 100 comprises a dorsal region 11 adapted to cover the back or dorsum of a user's hand. The dorsal region 11 may comprise a pull strap anchor 13 (FIGS. 3,4,5,6) coupled to and positioned on the exterior surface 11A of the dorsal region 11 and optionally a pull strap anchor strap 13A removably coupled to the pull strap anchor 13. One or more phalange regions 14, 15, 16, 17, and 18, configured to receive a finger of a hand may be coupled to the dorsal region 11. In further embodiments, a thumb phalange region 14 may be configured to receive portions of the thumb or a user, an index phalange region 15 may be configured to receive portions of the index finger of a user, a middle phalange region 16 may be configured to receive portions of the middle finger of a user, a ring phalange region 17 may be configured to receive portions of the ring finger of a user, and a little phalange region 18 may be configured to receive portions of the little finger of a user.

Each phalange region 14, 15, 16, 17, and 18, may comprise a posterior phalange region such as a posterior thumb phalange region 14A, posterior index phalange region 15A, posterior middle phalange region 16A, posterior ring phalange region 17A, and posterior little phalange region 18A, coupled to and extending outwardly from the dorsal region 11. A thumb phalange region 14 may extend outwardly from the dorsal region 11 and may be coupled to a first end 21A of a first pull strap 21. An index phalange region 15 may be disposed adjacent to the thumb phalange region 14, and the index phalange region 18 may be coupled to a first end 22A of a second pull strap 22. A middle phalange region 16 may be disposed adjacent the index phalange region 15, and the middle phalange region 16 may be coupled to a first end 23A of a third pull strap 23. A ring phalange region 17 may be disposed adjacent to the middle phalange region 16, and the ring phalange region 17 may be coupled to a first end 24A of a fourth pull strap 24. A little phalange region 18 may be disposed adjacent to the ring phalange region 17, and the little phalange region 18 may be coupled to a first end 25A of a fifth pull strap 25.

Each pull strap 21, 22, 23, 24, and 25, may also comprise a second end 21B, 22B, 23B, 24B, and 25B, which may be removably coupled to the pull strap anchor 13 thereby exerting a reverse counterforce against the phalange regions 14, 15, 16, 17, and 18, to pull the fingers and the thumb of the user's hand which are received in a respective phalange region back straight so as to open the hand and prevent involuntary clenching. In some embodiments, a pull strap 21, 22, 23, 24, and 25, may be formed from or comprise elastic materials such as elastane fibres, spandex, lastex, Lycra®, rubber, silicone rubber, elastic plastics, or any other material or combination of materials that is substantially able to regain its shape after deformation. In further embodiments, a pull strap 21, 22, 23, 24, and 25, may be formed from or comprise elastic material that is continuous in elastic properties along the entire length of the pull strap 21, 22, 23, 24, and 25, to extend from a phalange region 14, 15, 16, 17, and 18, to be temporarily coupled to the pull strap anchor 13.

In further embodiments, a pull strap 21, 22, 23, 24, and 25, may be formed from or comprise inelastic materials such as nylon webbing, polypropylene webbing, polyester webbing, neoprene foam rubber, polyester fabrics, rayon fabrics, and from natural materials and fibers such as cotton webbing, flax webbing, other fabrics, such as flax, coir, cotton, hemp, jute, leather, linen, ramie, wool, silk or any other type of natural or synthetic fibers or materials including combinations of materials. In further embodiments, a pull strap 21, 22, 23, 24, and 25, may be formed from or comprise inelastic material that is continuous in inelastic properties along the entire length of the pull strap 21, 22, 23, 24, and 25 to extend from a phalange region 14, 15, 16, 17, and 18, to be temporarily coupled to the pull strap anchor 13.

Figure 2:
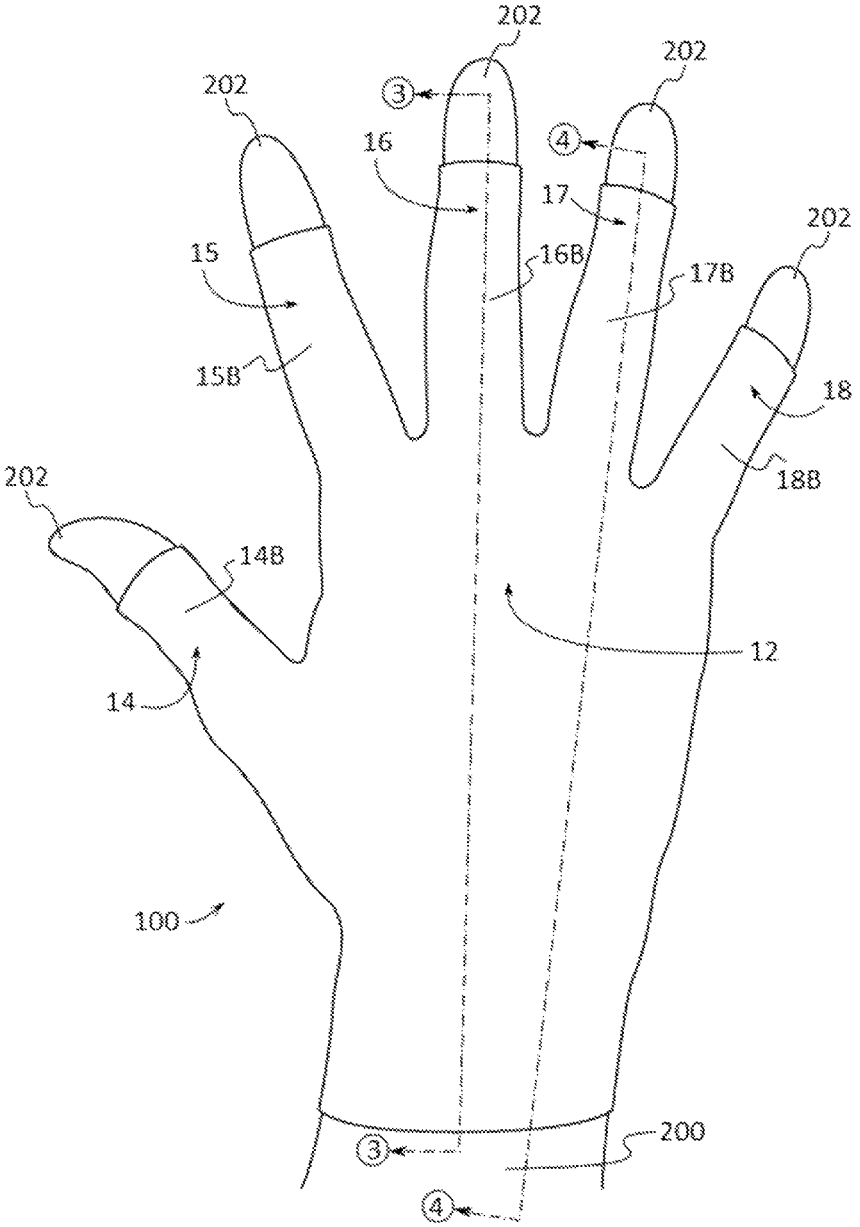
FIG. 2 illustrates an anterior perspective view of an example of a clench arresting glove secured to the hand of a user according to various embodiments described herein.

FIG. 2 illustrates an anterior perspective view of an example of a clench arresting glove 100 secured to the user's hand 200 according to various embodiments described herein. In this example, the glove 100 comprises an anterior region 12 adapted to cover the front or palmar region of a user's hand. One or more phalange regions 14, 15, 16, 17, and 18, configured to receive a finger of a hand may be coupled to the anterior region 12. Each phalange region 14, 15, 16, 17, and 18, may extend outwardly from the dorsal region 11 and may comprise an anterior phalange region such as anterior thumb phalange region 14B, anterior index phalange region 15B, anterior middle phalange region 16B, anterior ring phalange region 17B, and anterior little phalange region 18B, coupled to and extending outwardly from the anterior region 12.

Figure 3:
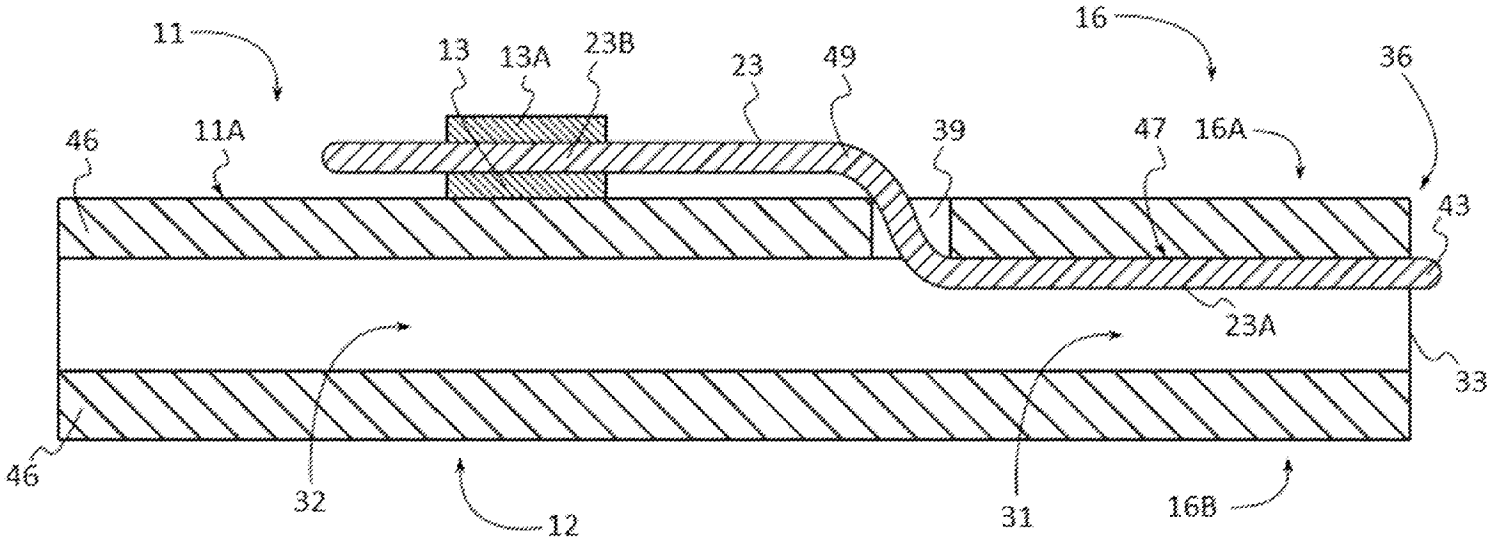
FIG. 3 shows a sectional, through line 3-3 shown in FIG. 2, elevation view of an example of a clench arresting glove according to various embodiments described herein.
Figure 4:
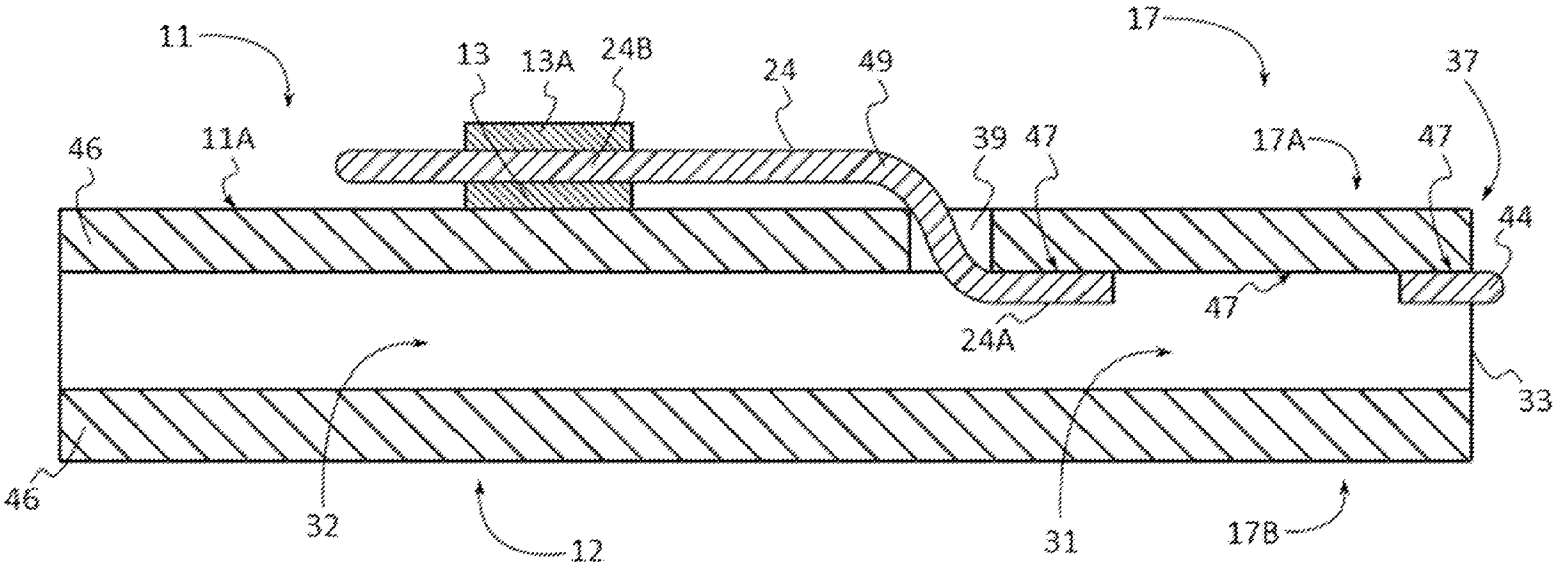
FIG. 4 depicts a sectional, through line 4-4 shown in FIG. 2, elevation view of an alternative example of a clench arresting glove according to various embodiments described herein.

Turning now to FIG. 3, a sectional, through line 3-3 shown in FIG. 2, elevation view of an example of a clench arresting glove 100, while FIG. 4 shows a sectional, through line 4-4 also shown in FIG. 2, elevation view of an example of a clench arresting glove 100 according to various embodiments described herein. While FIG. 3 refers to the middle phalange region 16 which is configured to receive the middle finger of a user's hand and FIG. 4 refers to the ring phalange region 17 which is configured to receive the ring finger of a user's hand, FIGS. 3 and 4 may be representative for the other phalange regions 14, 15, and 18 which may comprise the same elements however in different dimensions to facilitate each phalange region to receive a respective finger. For example, each phalange region 14, 15, 16, 17, and 18, may each comprise a phalange cavity 31 configured to receive a finger and a metacarpus cavity 32 configured to receive a metacarpus of a user's hand. Each phalange region 14, 15, 16, 17, and 18, may also comprise a phalange aperture 33 at their distal ends 34, 35, 36, 37, and 38, configured to allow a fingertip 202 of a user's hand 201 to protrude slightly out from the glove 100. For example, the thumb phalange region 14, index phalange region 15, middle phalange region 16, ring phalange region 17, and little phalange region 18 may each terminate with a phalange aperture 33 at their distal ends 34, 35, 36, 37, and 38, configured to allow the fingertips 202 (FIGS. 1, 2, 5, and 6) of a user's hand 201 to protrude slightly out from the glove 100.

In further embodiments, each phalange region 14, 15, 16, 17, and 18, may comprise a distal end such as a thumb phalange distal end 34, an index phalange distal end 35, a middle phalange distal end 36, a ring phalange distal end 37, and a little phalange distal end 38. A pull tab such as a first pull tab 41, second pull tab 42, third pull tab 43, fourth pull tab 44, and fifth pull tab 45 may be coupled to and be protruding slightly outwards and away from a distal end 34, 35, 36, 37, and 38, of each phalange region 14, 15, 16, 17, and 18.

Each phalange region 14, 15, 16, 17, and 18, may be coupled to its respective pull strap 21, 22, 23, 24, and 25. As shown in FIGS. 3 and 4, each phalange region 14, 15, 16, 17, and 18 may comprise a phalange cavity 31 which may be formed by the glove body 46. A phalange of a user may be inserted into a phalange cavity 31 which may further comprise and be bounded by an interior phalange cavity surface 47. In some embodiments, the first end 21A of the first pull strap 21 may be mounted to an interior phalange cavity surface 47 within the thumb phalange region 14; the first end 22A of the second pull strap 22 may be mounted to an interior phalange cavity surface 47 within the index phalange region 15; the first end 23A of the third pull strap 23 may be mounted to an interior phalange cavity surface 47 within the middle phalange region 16; the first end 24A of the fourth pull strap 24 may be mounted to an interior phalange cavity surface 47 within the ring phalange region 17; and the first end 25A of the fifth pull strap 25 may be mounted to an interior phalange cavity surface 47 within the little phalange region 18.

In still further embodiments, a pull strap 21, 22, 23, 24, and 25, may be integrally formed with a pull tab 41, 42, 43, 44, and 45 as shown in FIG. 3. For example, a first pull tab 41 may be integrally formed with the first pull strap 21. A second pull tab 42 may be integrally formed with the second pull strap 22. A third pull tab 43 may be integrally formed with the third pull strap 23. Likewise, a fourth pull tab 44 may be integrally formed with the fourth pull strap 24. Finally, a fifth pull tab 45 may be integrally formed with the fifth pull strap 25. A pull tab 41, 42, 43, 44, and 45 and/or pull strap 21, 22, 23, 24, and 25 which are integrally formed may either or both be coupled to an interior phalange cavity surface 47 within their respective phalange region 14, 15, 16, 17, and 18.

In alternative embodiments, such as depicted in FIG. 4, a pull strap 21, 22, 23, 24, and 25, may not be integrally formed with a pull tab 41, 42, 43, 44, and 45. Each pull strap 21, 22, 23, 24, and 25, may be coupled to its respective phalange region 14, 15, 16, 17, and 18, while each pull tab 41, 42, 43, 44, and 45, may be coupled to a different portion of phalange region 14, 15, 16, 17, and 18. In further alternative embodiments, each pull tab 41, 42, 43, 44, and 45 may be coupled to and be protruding slightly outwards and away from a distal end 34, 35, 36, 37, and 38, of each phalange region 14, 15, 16, 17, and 18.

A pull tab 41, 42, 43, 44, and 45, and/or a pull strap 21, 22, 23, 24, and 25, may be coupled to its respective phalange region 14, 15, 16, 17, and 18, such as to an interior phalange cavity surface 47 of its respective phalange region 14, 15, 16, 17, and 18 with heat bonding, chemical bonding, adhesives, stitching, clasp type fasteners, clip type fasteners, rivet type fasteners 50 (FIG. 6A), threaded type fasteners, other types of fasteners, or any other suitable joining method. In some embodiments as shown by FIG. 6A, rivet type fasteners 50 may be used to attach pull tabs 41, 42, 43, 44, and 45, and/or a pull straps 21, 22, 23, 24, and 25, to respective phalange regions 14, 15, 16, 17, and 18. Rivet type fasteners 50 may be flat or low profile and may be made from copper or any suitable metal or plastic material.

Figure 5:
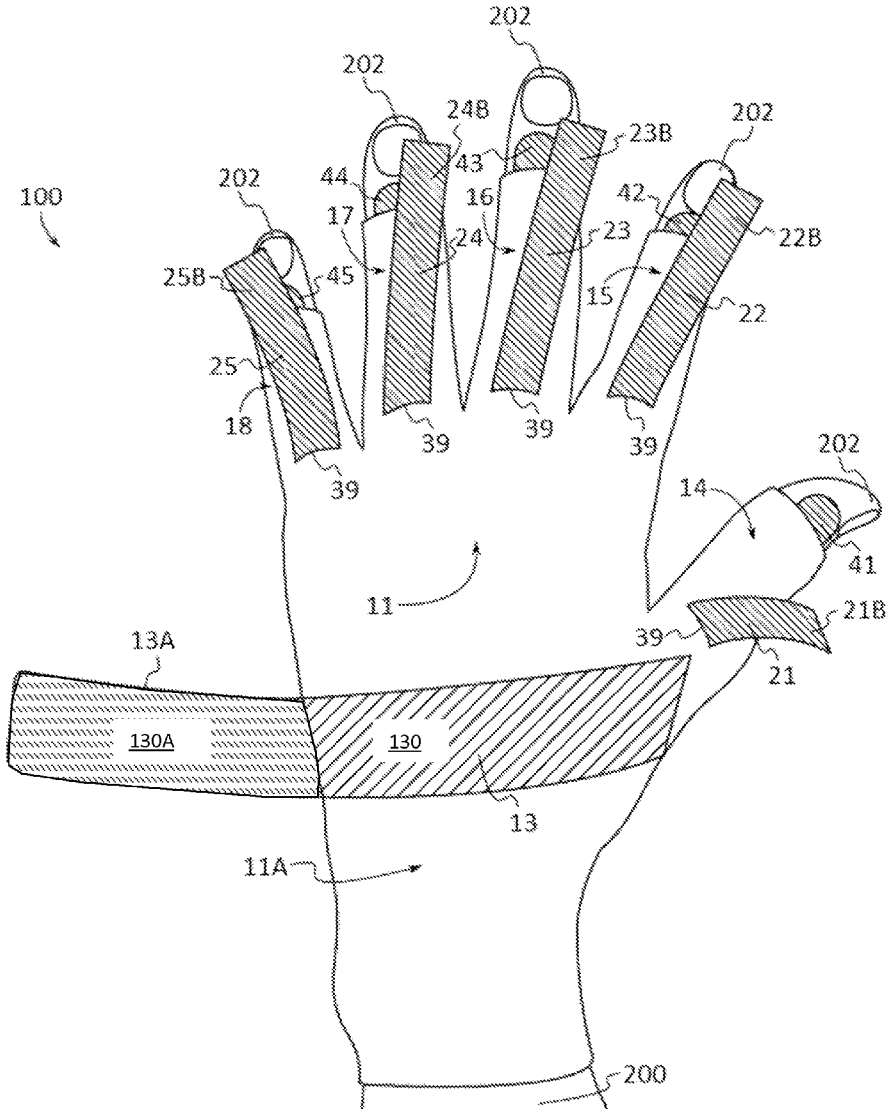
FIG. 5 illustrates a posterior perspective view of an example of a clench arresting glove on the hand of a user according to various embodiments described herein.

In some embodiments, and as shown in FIGS. 3, 4, and 5, each phalange region 14, 15, 16, 17, and 18, may comprise a pull strap aperture 39 which may allow the second end 21B, 22B, 23B, 24B, and 25, of a pull strap 21, 22, 23, 24, and 25, to be temporarily or removably coupled to the pull strap anchor 13 on the dorsal region 11, while the first end 21A, 22A, 23A, 24A, and 25A, is coupled to an interior phalange cavity surface 47 of a respective phalange region 14, 15, 16, 17, and 18. For example, in some embodiments, the glove 100 may comprise a dorsal region 11 adapted to cover the back of a user's hand, with the dorsal region 11 comprising a pull strap anchor 13 positioned on the exterior surface 11A of the glove 100. The glove 100 may further comprise: a posterior thumb phalange region 14A extending outwardly from the dorsal region 11 and terminating at a thumb phalange distal end 34; a posterior index phalange region 15A disposed adjacent the posterior thumb phalange region 14A and terminating at a index phalange distal end 35, with the posterior index phalange region 15A having a pull strap aperture 39 providing access to a phalange cavity 31 of the index phalange region 15; a posterior middle phalange region 16A adjacent the posterior index phalange region 15A and terminating at a middle phalange distal end 36, with the posterior middle phalange region 16A having a pull strap aperture 39 providing access to a phalange cavity 31 of the middle phalange region 16; a posterior ring phalange region 17A adjacent the posterior middle phalange region 16A and terminating at a ring phalange distal end 37, with the posterior ring phalange region 17A having a pull strap aperture 39 providing access to a phalange cavity 31 of the ring phalange region 17; a posterior little phalange region 18A adjacent the posterior ring phalange region 17A and terminating at a little phalange distal end 38, said posterior little phalange region 18A having a pull strap aperture 39 providing access to a phalange cavity 31 of the little phalange region 18. In further embodiments, the thumb phalanges region 14 may comprise a posterior thumb phalange region 14A having a pull strap aperture 39 providing access to a phalange cavity 31 of the thumb phalange region 14. The pull strap apertures 39 may be configured to receive a pull strap 21, 22, 23, 24, and 25, having a first end 21A, 22A, 23A, 24A, and 25A and a second end 21B, 22B, 23B, 24B, and 25B, with the pull strap first end 21A, 22A, 23A, 24A, and 25A, coupled to an interior phalange cavity surface 47 and said pull strap second end 21B, 22B, 23B, 24B, and 25B, removably coupled to the pull strap anchor 13.

In further embodiments, the thumb phalange region 14, index phalange region 15, middle phalange region 16, ring phalange region 17, and little phalange region 18 may each comprise a pull strap aperture 39 configured to receive a pull strap 21, 22, 23, 24, and 25, from an interior phalange cavity 31 and allowing the pull strap 21, 22, 23, 24, and 25, to transition from an interior phalange cavity 31 to the posterior exterior of the glove 48. In still further embodiments, each pull strap aperture 39 may be positioned between the pull strap anchor 13 and the distal end 34, 35, 36, 37, and 38 of each phalange region 14, 15, 16, 17, and 18. In even further embodiments, each pull strap 21, 22, 23, 24, and 25 may comprise a pull strap knuckle region 49 which may be formed by the portion of a pull strap 21, 22, 23, 24, and 25 that extends over the interphalangeal and metacarpophalangeal finger joint commonly referred to as the knuckle joint of each finger, and each pull strap aperture 39 may be positioned proximate to a pull strap knuckle region 49.

As perhaps best shown in FIGS. 3 and 4, a pull strap anchor 13 and the pull straps 21, 22, 23, 24, and 25, may comprise a removable or temporarily coupled fastener such as hook and loop or Velcro® fasteners. A pull strap 21, 22, 23, 24, and 25, may be removably coupled or temporarily coupled to portions of the pull strap anchor 13. Optionally, a pull strap anchor 13 may comprise a portion that may extend away from the dorsal region 11, such as a pull strap anchor strap 13A that may be removable or temporarily coupled over portions of a pull strap second end 21B, 22B, 23B, 24B, and 25B, which is removably or temporarily coupled to the pull strap anchor 13. In other embodiments, a pull strap anchor 13 and the pull straps 21, 22, 23, 24, and 25, may be removably or temporarily coupled by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function.

In some embodiments, the glove body 46 and/or one or more of the dorsal region 11, thumb phalange region 14, index phalange region 15, middle phalange region 16, ring phalange region 17, and little phalange region 18 of the glove 100 may be constructed from or comprise various types of compressionable materials such as blends of cotton and elastic materials such as Lycra®. For example, the glove body 46 of the glove 100 may be made from compressionable material formed by a blend of 92% cotton and 8% of an elastic material such as elastane fibres and Lycra®, however more or less elastic material may form a blend to increase or decrease, respectively, the compression of a compressionable material used to form the glove body 46. In further embodiments, the glove body 46 of the glove 100 may be made from or comprise various types of compressionable materials further comprising natural or synthetic rubber, synthetic fabrics such as polyester, acrylic, nylon, rayon, acetate, Kevlar®, elastic materials such as elastane fibres, spandex, lastex, and Lycra®, and natural fabrics such as coir, cotton, hemp, jute, leather, linen, ramie, wool, silk, or any other suitable flexible natural or synthetic material including combinations or blends of materials. In further embodiments, compressionable material may comprise a blend of inelastic materials such as synthetic fabrics such as polyester, acrylic, nylon, rayon, acetate, Kevlar®, and natural fabrics such as coir, cotton, hemp, jute, leather, linen, ramie, wool, silk, which may be blended with elastic materials such as spandex, lastex, Lycra®, and the like. In still further embodiments, the glove body 46 of the glove 100 may be made from or comprise compressionable materials which may further comprise elastic and/or cushioning materials such as ARTiLAGE foams, Poron foams, silicone foams, rubber foams, plastic foams, neoprene foam, latex foam rubber, polyurenthane foam rubber, or elastomer materials such as elastic plastics, elastic silicone, elastic rubbers, silicone rubbers, or any other suitable elastomer or resilient material.

In some embodiments, a pull strap anchor 13 may be configured to temporarily or removably couple one or more second ends 21B, 22B, 23B, 24B, and 25B, of one or more pull straps 21, 22, 23, 24, and 25, under tension. Tension may be applied to a pull strap 21, 22, 23, 24, and 25 by pulling a second end 21B, 22B, 23B, 24B, and 25B until the desired amount of reverse counterforce against the phalange regions as to resist the moving of a phalange region 14, 15, 16, 17, and 18, toward the anterior region 12 (FIG. 2) and then temporarily or removably coupling the second end 21B, 22B, 23B, 24B, and 25B, to the pull strap anchor 13.

FIG. 5 illustrates a posterior perspective view of an example of a clench arresting glove 100 on the user's hand 200 according to various embodiments described herein. In this illustration, the tension is relieved from each pull strap 21, 22, 23, 24, and 25, since each pull strap second end 21B, 22B, 23B, 24B, and 25B, is not coupled to the pull strap anchor 13 or in particular, to the pull strap anchor surface 130 which preferably contains one of a loop style fastener, or, a hook style fastener of a hook and loop or Velcro® fastener. Additionally, the pull strap anchor strap 13A is shown extended away from the dorsal region 11. In this view, we can also see an interior surface 130A of the pull strap anchor strap 13A where the interior surface 130A preferably contains one of a loop style fastener, or, a hook style fastener of a hook and loop or Velcro® fastener. Once a pull strap second end 21B, 22B, 23B, 24B, and 25B, is removably coupled to the pull strap anchor 13 (such as through hook and loop or Velcro® fasteners), the respective pull strap 21, 22, 23, 24, and 25, may exert a reverse counterforce against a respective phalange region 14, 15, 16, 17, and 18 as to open the hand and prevent involuntary clenching. By decreasing the length of pull strap 21, 22, 23, 24, and 25, between the respective phalange region 14, 15, 16, 17, and 18 and the pull strap anchor 13, the amount of reverse counterforce exerted may be increased. Conversely, by increasing the length of pull strap 21, 22, 23, 24, and 25, between the respective phalange region 14, 15, 16, 17, and 18 and the pull strap anchor 13, the amount of reverse counterforce exerted may be decreased.

Figure 6:
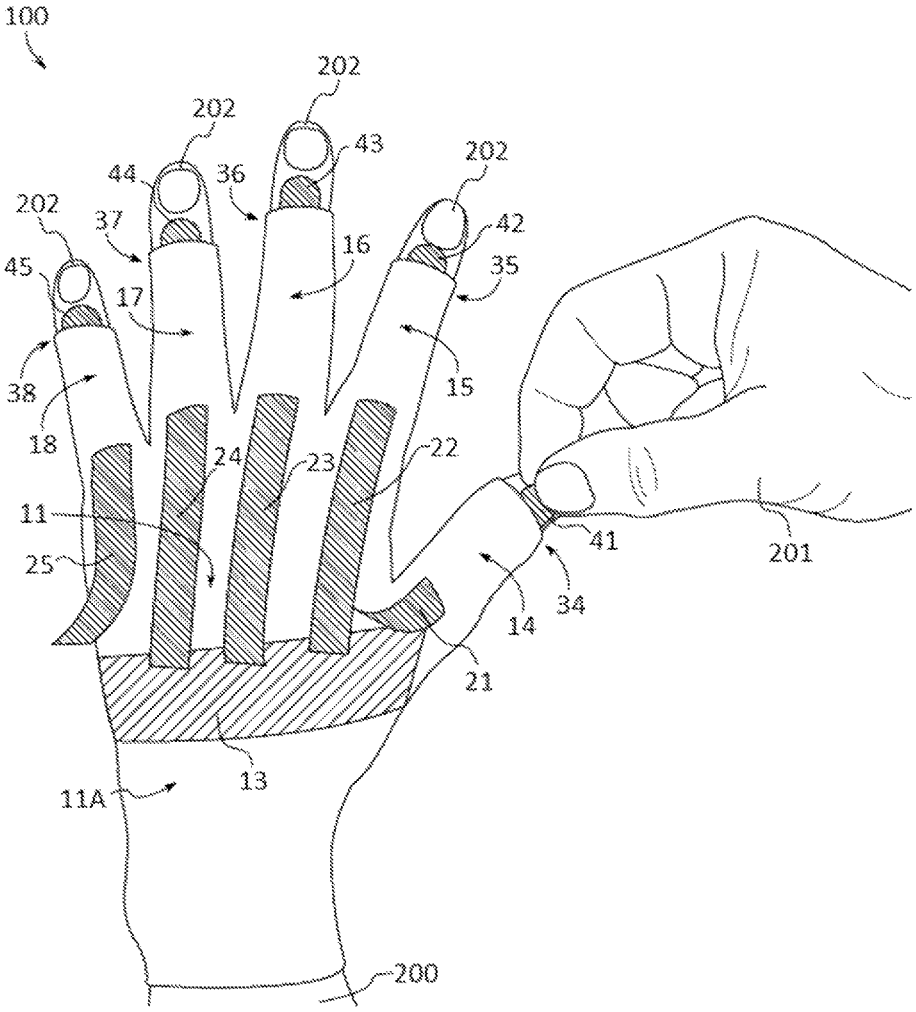
FIG. 6 shows a posterior perspective view of an example of a clench arresting glove being removed from the hand of a user according to various embodiments described herein.
Figure 6A:
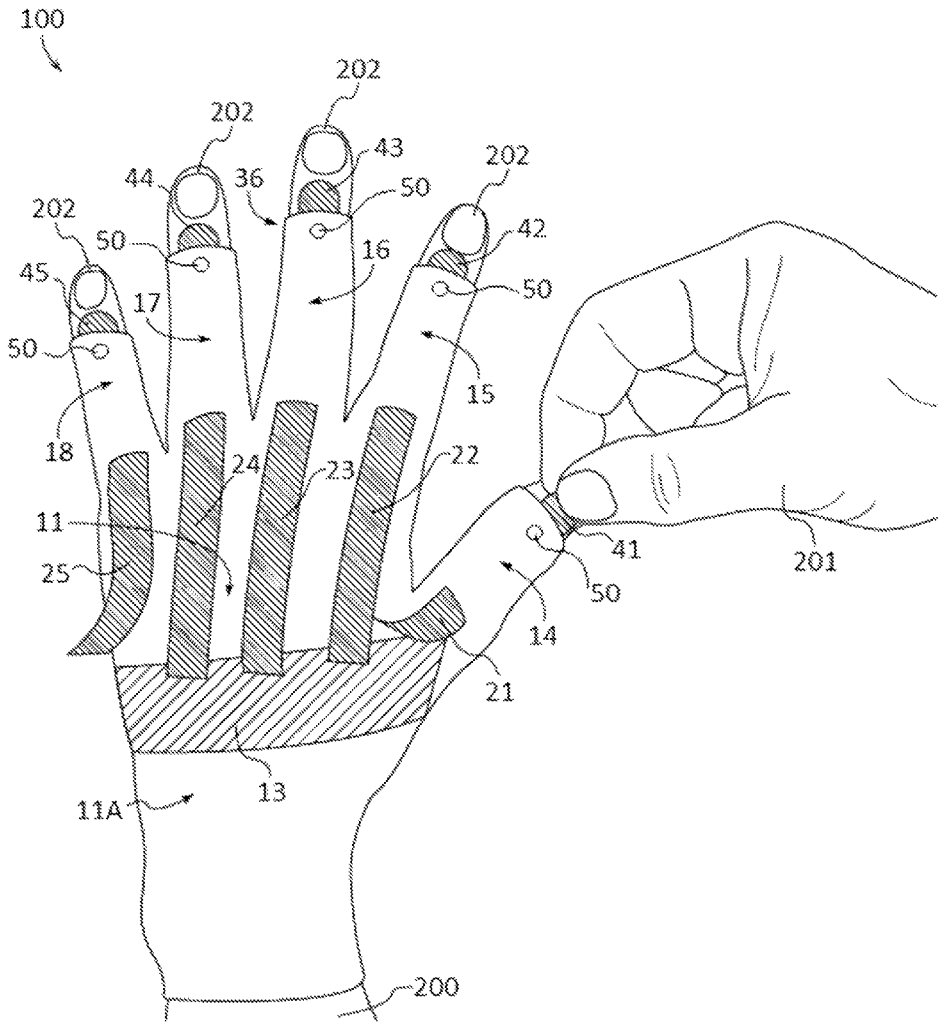
FIG. 6A shows a posterior perspective view of an example of a clench arresting glove being removed from the hand of a user according to various embodiments described herein.

FIG. 6 shows a posterior perspective view of an example of a clench arresting glove 100 being removed from the hand of a user 200 according to various embodiments described herein. In this embodiment, one or more pull tabs 41, 42, 43, 44, and 45 may be manipulated to facilitate the removal of the glove 100 from the hand of a user 200. One or more phalange regions 14, 15, 16, 17, and 18, may comprise a pull tab 41, 42, 43, 44, and 45 coupled to, and protruding slightly outwards away from, a distal end 34, 35, 36, 37, and 38 of each phalange region 14, 15, 16, 17, and 18. A user may pull a pull tab 41, 42, 43, 44, and 45 in a general direction away from the hand to facilitate removing one or more fingers from one or more phalange regions 14, 15, 16, 17, and 18.

While some preferred materials for elements have been described, the glove 100 is not limited by these materials. In other embodiments, one or more elements that comprise the glove 100 may be made from durable materials such as hard plastics, metal alloys, wood, hard rubbers, carbon fiber, fiber glass, resins, polymers or any other suitable materials including combinations of materials. Additionally, one or more elements may be made from or comprise durable and slightly flexible materials such as soft plastics, silicone, soft rubbers, fabrics, or any other suitable materials including combinations of materials.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A therapeutic glove configured to be worn on a person's hand, the glove comprising:

a. a dorsal region adapted to cover the back of a person's hand, said dorsal region comprising a pull strap anchor positioned on the dorsal exterior surface of the glove;

b. a thumb phalange region extending outwardly from the dorsal region, said thumb phalange region coupled to a first end of a first pull strap, said first pull strap having a second end removably coupled to the pull strap anchor and exerting a reverse counterforce against the thumb phalange region through the first pull strap thereby pulling the thumb phalange region towards the pull strap anchor;

c. a index phalange region disposed adjacent the thumb phalange region, said index phalange region coupled to a first end of a second pull strap, said second pull strap having a second end removably coupled to the pull strap anchor and exerting a reverse counterforce against the index phalange region through the second pull strap thereby pulling the index phalange region towards the pull strap anchor;

d. a middle phalange region adjacent the index phalange region, said middle phalange region coupled to a first end of a third pull strap, said third pull strap having a second end removably coupled to the pull strap anchor and exerting a reverse counterforce against the middle phalange region through the third pull strap thereby pulling the middle phalange region towards the pull strap anchor;

e. a ring phalange region adjacent the middle phalange region, said ring phalange region coupled to a first end of a fourth pull strap, said fourth pull strap having a second end removably coupled to the pull strap anchor and exerting a reverse counterforce against the ring phalange region through the fourth pull strap thereby pulling the ring phalange region towards the pull strap anchor;

f. a little phalange region adjacent the ring phalange region, said little phalange region coupled to a first end of a fifth pull strap, said fifth pull strap having a second end removably coupled to the pull strap anchor and exerting a reverse counterforce against the little phalange region through the fifth pull strap thereby pulling the little phalange region towards the pull strap anchor.

2. The glove according to claim 1, wherein the dorsal region, thumb phalange region, index phalange region, middle phalange region, ring phalange region, and little phalange region are constructed from a compressionable material.

3. The glove according to claim 2, wherein the compressionable material comprises an inelastic material selected from one of: polyester, acrylic, nylon, rayon, acetate, coir, cotton, hemp, jute, leather, linen, ramie, wool, or silk which is blended with an elastic material selected from one of: elastane fibres, spandex, and latex.

4. The glove according to claim 1, wherein the reverse counterforce on the thumb phalange region, the index phalange region, the middle phalange region, the ring phalange region, and the little phalange region may be relieved by uncoupling the first pull strap, second pull strap, third pull strap, fourth pull strap, and fifth pull strap from the pull strap anchor.

5. The glove according to claim 1, wherein the thumb phalange region, index phalange region, middle phalange region, ring phalange region, and little phalange region each comprise a pull tab coupled to, and protruding slightly outwards away from, a distal end of each phalange region.

6. The glove according to claim 5, wherein;

a. a first pull tab is integrally formed with the first end of the first pull strap;

b. a second pull tab is integrally formed with the first end of the second pull strap;

c. a third pull tab is integrally formed with the first end of the third pull strap d. a fourth pull tab is integrally formed with the first end of the fourth pull strap; and e. a fifth pull tab is integrally formed with the first end of the fifth pull strap.

7. The glove according to claim 1, wherein the first, second, third, fourth, and fifth pull straps are formed from a continuous elastic material and extend from a phalange region to the pull strap anchor.

8. The glove according to claim 1, wherein the first, second, third, fourth and fifth pull straps are formed from a continuous inelastic material and extend from a phalange region to the pull strap anchor.

9. The glove according to claim 1, wherein the thumb phalange region, index phalange region, middle phalange region, ring phalange region, and little phalange region each terminate with a phalange aperture configured to allow a fingertip of a person's hand to protrude slightly out from the glove.

10. The glove according to claim 9, further comprising a pull tab coupled to, and protruding slightly outwards away from, a distal end of each phalange region.

11. A glove comprising:

a. a dorsal region adapted to cover the back of a person's hand, said dorsal region comprising a pull strap anchor positioned on the exterior surface of the glove;

b. a posterior thumb phalange region extending outwardly from the dorsal region and terminating at a thumb phalange distal end;

c. a posterior index phalange region disposed adjacent the posterior thumb phalange region and terminating at an index phalange distal end, said posterior index phalange region having a pull strap aperture providing access to a phalange cavity;

d. a posterior middle phalange region adjacent the posterior index phalange region and terminating at a middle phalange distal end, said posterior middle phalange region having a pull strap aperture providing access to a phalange cavity;

e. a posterior ring phalange region adjacent the posterior middle phalange region and terminating at a ring phalange distal end, said posterior ring phalange region having a pull strap aperture providing access to a phalange cavity;

f. a posterior little phalange region adjacent the posterior ring phalange region and terminating at a little phalange distal end, said posterior little phalange region having a pull strap aperture providing access to a phalange cavity;

wherein the pull strap apertures are configured to receive a pull strap having a first end and a second end, said pull strap first end coupled to an interior phalange cavity surface and said pull strap second end removably coupled to the pull strap anchor.

12. The glove according to claim 11, wherein the pull strap second end is removable coupled to the pull strap anchor with a hook and loop style fastener.

13. The glove according to claim 11, wherein the glove is formed from a compressionable material.

14. The glove according to claim 13, wherein the compressionable material comprises an inelastic material selected from one of: polyester, acrylic, nylon, rayon, acetate, coir, cotton, hemp, jute, leather, linen, ramie, wool, or silk which is blended with an elastic material selected from one of: elastane fibres, spandex, and latex.

15. The glove according to claim 11, wherein the posterior thumb phalange region, posterior index phalange region, posterior middle phalange region, posterior ring phalange region, and posterior little phalange region each comprise a pull tab mounted to, and protruding slightly outwards away from, a distal end of each phalange region.

16. The glove according to claim 11, wherein the pull strap is formed from a continuous elastic material.

17. The glove according to claim 11, wherein the posterior thumb phalange region, posterior index phalange region, posterior middle phalange region, posterior ring phalange region, and posterior little phalange region each terminate with a phalange aperture configured to allow a fingertip of a person's hand to protrude slightly out from the glove.

18. A therapeutic glove configured to be worn on a person's hand, the glove comprising:

a. a dorsal region adapted to cover the back of a person's hand, said dorsal region comprising a pull strap anchor positioned on the dorsal exterior surface of the glove;

b. a thumb phalange region extending outwardly from the dorsal region to a distal tip comprising a first pull tab, said thumb phalange region coupled to a first end of a first pull strap, said first pull strap having a second end removably coupled to the pull strap anchor exerting a reverse counterforce against the thumb phalange region through the first pull strap;

c. a index phalange region disposed adjacent the thumb phalange region and extending outwardly to a distal tip comprising a second pull tab, said index phalange region coupled to a first end of a second pull strap, said second pull strap having a second end removably coupled to the pull strap anchor exerting a reverse counterforce against the index phalange region through the second pull strap;

d. a middle phalange region adjacent the index phalange region and extending outwardly to a distal tip comprising a third pull tab, said middle phalange region coupled to a first end of a third pull strap, said third pull strap having a second end removably coupled to the pull strap anchor exerting a reverse counterforce against the middle phalange region through the third pull strap;

e. a ring phalange region adjacent the middle phalange region and extending outwardly to a distal tip comprising a fourth pull tab, said ring phalange region coupled to a first end of a fourth pull strap, said fourth pull strap having a second end removably coupled to the pull strap anchor exerting a reverse counterforce against the ring phalange region through the fourth pull strap;

f. a little phalange region adjacent the ring phalange region and extending outwardly to a distal tip comprising a fifth pull tab, said little phalange region coupled to a first end of a fifth pull strap, said fifth pull strap having a second end removably coupled to the pull strap anchor exerting a reverse counterforce against the little phalange region through the fifth pull strap.

19. The glove according to claim 18, wherein a posterior thumb phalange region, a posterior index phalange region, a posterior middle phalange region, a posterior ring phalange region, and a posterior little phalange region each terminate with a phalange aperture configured to allow a fingertip of a person's hand to protrude slightly out from the glove proximate to a pull tab.

20. The glove according to claim 18, wherein;

a. the first pull tab is integrally formed with the first end of the first pull strap;

b. the second pull tab is integrally formed with the first end of the second pull strap;

c. the third pull tab is integrally formed with the first end of the third pull strap d. the fourth pull tab is integrally formed with the first end of the fourth pull strap; and e. the fifth pull tab is integrally formed with the first end of the fifth pull strap.

21. The glove according to claim 18, wherein the reverse counterforce on the thumb phalange region, the index phalange region, the middle phalange region, the ring phalange region, and the little phalange region may be relieved by uncoupling the first pull strap, second pull strap, third pull strap, fourth pull strap, and fifth pull strap from the pull strap anchor.

* * * * *